US007406281B2

(12) United States Patent
Ahn et al.

(10) Patent No.: US 7,406,281 B2
(45) Date of Patent: Jul. 29, 2008

(54) IMAGE FORMING APPARATUS AND METHOD THEREOF

(75) Inventors: Myung-kook Ahn, Suwon-si (KR); In-yong Song, Suwon-si (KR); Sang-don Lee, Gwacheon-si (KR)

(73) Assignee: Samsung Electronics Co., Ltd., Maetan-dong, Yeongtong-gu, Suwon-si, Gyeonggi-do (KR)

( * ) Notice: Subject to any disclaimer, the term of this patent is extended or adjusted under 35 U.S.C. 154(b) by 309 days.

(21) Appl. No.: 11/296,384

(22) Filed: Dec. 8, 2005

(65) Prior Publication Data

US 2006/0133860 A1 Jun. 22, 2006

(30) Foreign Application Priority Data

Dec. 20, 2004 (KR) ..... 10-2004-0108573

(51) Int. Cl.
*G03G 15/01* (2006.01)

(52) U.S. Cl. ..... 399/299; 399/39; 399/54; 399/231

(58) Field of Classification Search ..... 399/39, 399/40, 54, 57, 58, 231, 233
See application file for complete search history.

(56) References Cited

U.S. PATENT DOCUMENTS

2004/0265714 A1* 12/2004 Miyakawa et al. ..... 430/45

FOREIGN PATENT DOCUMENTS

| | | |
|---|---|---|
| JP | 06-149001 | 5/1994 |
| JP | 08-234526 | 9/1996 |
| JP | 2000-259000 | 9/2000 |
| KR | 1020020018034 | 3/2002 |
| KR | 1020020025014 | 4/2002 |
| KR | 1020040043579 | 5/2004 |

* cited by examiner

*Primary Examiner*—David M Gray
*Assistant Examiner*—Joseph S. Wong
(74) *Attorney, Agent, or Firm*—Roylance, Abrams, Berdo & Goodman, LLP

(57) ABSTRACT

An image forming apparatus is provided that forms an image with liquid developer, and a method thereof. The image forming apparatus includes a plurality of photoconductors on which developer images having carrier rates different from each other are formed with corresponding liquid developers. An image transfer member is disposed to form transfer nips with the respective photoconductors in such a manner that the developer images of the respective photoconductors are overlappingly transferred onto the image transfer member according to a transfer order predetermined on the basis of the carrier rates thereof. The developer images from the respective photoconductors are moved to an image receiving medium. Since the developer images formed on the plurality of photoconductors are overlappingly transferred onto the image transfer member according to the predetermined transfer order, the developer images previously transferred at the prior transfer nips are substantially prevented from generating a squeezed carrier beyond a predetermined limit at the posterior transfer nips. The squeezed carrier is substantially prevented from accumulating beyond the predetermined limit at the inlet side of the posterior transfer nips when the developer images are transferred from the respective photoconductors to the image transfer member.

17 Claims, 6 Drawing Sheets

IMAGE FORMING APPARATUS AND METHOD THEREOF

CROSS-REFERENCE TO RELATED APPLICATIONS

This application claims the benefit under 35 U.S.C. § 119 (a) of Korean Patent Application No. 2004-108573, filed on Dec. 20, 2004, in the Korean Intellectual Property Office, the entire disclosure of which is hereby incorporated by reference.

BACKGROUND OF THE INVENTION

1. Field of the Invention

The present invention relates to an image forming apparatus, such as an electrophotographic printer. More particularly, the present invention relates to an image forming apparatus that forms an image with liquid developer and a method thereof.

2. Description of the Related Art

Generally, an image forming apparatus, such as an electrophotographic printer, forms an electrostatic latent image on a photoconductor, such as a photoconductive belt or an organic photoconductive (OPC) drum. The latent image is developed with developer having a predetermined color. The developed image is transferred onto a sheet of record paper, thereby obtaining a desired image.

Such an electrophotographic image forming apparatus is classified into a wet type or a drying type depending on the developer employed therein. A wet type electrophotographic image forming apparatus uses a liquid developer formed by mixing powdered toner with a liquid carrier having volatile components as the developer.

FIG. 1 shows a conventional wet type electrophotographic color printer using a liquid developer.

As shown in FIG. 1, the wet type electrophotographic color printer 1 includes an image forming unit 5 and an image transfer unit 10.

The image forming unit 5 includes four image forming units, for example Y, M, C, and K image forming units, to form an image of four colors, that is, yellow (Y), magenta (M), cyan (C) and black (K).

Each of Y, M, C, and K image forming units is provided with a photoconductor 9 having a surface on which an electrostatic latent image is formed. An electrification roller 12 is disposed adjacent to the photoconductor 9 for electrifying the surface of the photoconductor 9 with a predetermined electric potential. A laser scanning unit 11 emits a light beam onto the electrified surface of the photoconductor 9 to form the electrostatic latent image thereon.

Below the photoconductor 9, a developing device 13 is disposed for developing the electrostatic latent image with liquid developer 48 having predetermined color, that is, Y, M, C, or K and a density in the range of, for example, 3 through 20% solid, thereby forming a developer image 49 (see FIG. 2) having a density in the range of, for example, 20 through 25% solid.

The image transfer unit 10 includes four first image transfer rollers 8, a second image transfer roller 23, and an image transfer belt 17. The image transfer belt 17 rotates along a path of endless track on a support roller 21 driven by a belt driving roller 22. As shown in FIG. 2, each first image transfer roller 8 applies predetermined voltage and pressure to the developer image 49 of Y, M, C, or K formed on corresponding photoconductor 9 to form developer image 49' having a density in the range of, for example, 25 through 30% solid, and at the same time transfers the formed developer image 49' onto the image transfer belt 17. The second image transfer roller 23 transfers the developer images 49' transferred onto the image transfer belt 17 to an image receiving medium P, such as a sheet of record paper.

According to the conventional printer 1 configured as described above, when the developer images 49 formed on the respective photoconductors 9 are overlappingly transferred onto the image transfer belt 17 by the voltage and pressure of the respective first image transfer rollers 8, they are squeezed at transfer nips between the respective photoconductors 9 and the image transfer roller 17 by the pressure of the respective first image transfer rollers 8. As a result, the density of developer images 49 is changed from 20 through 25% solid to 25 through 30% solid.

At this time, however, at inlet sides of the transfer nips between the respective photoconductors 9 and the image transfer roller 17, liquid carrier 48' (referred as "squeezed carrier" below) is squeezed and generated from the developer image(s) 49' which is or are previously transferred onto the image transfer belt 17 and/or the developer image 49 which is newly transferred thereonto, and accumulated. The accumulated squeezed carrier 49 affects the developer image(s) 49' that is or are previously transferred onto the image transfer belt 17 and/or the developer image 49 that is newly transferred thereonto, thereby producing image defects.

More specifically, for example, when a developer image 49 (referred as "M developer image" below) of the photoconductor 9 (referred as "M photoconductor" below) that is at a second position from the leftmost side in FIG. 1 is overlapped and transferred onto a developer image 49' (referred as "Y developer image" below) previously transferred onto the image transfer belt 17 from prior photoconductor, that is, a photoconductor 9 (referred to as "Y photoconductor" below) that is at the leftmost side in FIG. 1, a squeeze carrier 48' is squeezed and generated from not only the newly transferred M developer image 49 but also the previously transferred Y developer image 49', and accumulated at an inlet side of transfer nip between the M photoconductor 9 and the image transfer roller 17. As a result, the newly transferred M developer image 49 and/or the previously transferred Y developer image 49' are affected by the squeeze carrier 48'. Therefore, image defects, such as flow pattern, image dragging and the like, result from an increase in the amount of carrier that may be produced as the developer images are overlappingly transferred onto the image transfer belt 17.

Such an image defect due to the squeeze carrier 48' is produced more severely at the posterior transfer nip rather than at the prior transfer nip. The reason is because at the posterior transfer nip, the newly transferred developer image 49 is squeezed along with the developer image 49' previously transferred at the prior transfer nip as the developer images 49 of the respective photoconductors 8 are overlappingly transferred onto the image transfer belt 17. The squeezed carrier 48' accumulated at the inlet side of the posterior transfer nip includes a squeezed carrier 48' squeezed from the developer image 49' previously transferred at the prior transfer nip as well as the newly transferred developer image 49.

Also, the more print, that is, the amount of the developer images 49 transferred to the image transfer belt 17 from the respective photoconductors 9, the greater the image defects produced due to the squeeze carrier 48'. The reason is that the more the amount of the transferred developer images, the greater the amount of the squeezed carrier 48' accumulated at the transfer nip.

Accordingly, there is required an image forming apparatus that when the developer images are overlappingly transferred onto the image transfer belt 17 from the respective photoconductors 9, the squeezed carrier 48' in liquid state is not accumulated at the inlet side of the respective transfer nips beyond a predetermined limit, thereby preventing image defects from being produced.

SUMMARY OF THE INVENTION

Accordingly, an object of the present invention is to provide an image forming apparatus and a method thereof. When developer images formed on a plurality of photoconductors are overlappingly transferred onto an image transfer belt, the squeezed carrier is not accumulated at inlet sides of transfer nips between the respective photoconductors and the image transfer belt beyond a predetermined limit, thereby preventing image defects from being produced.

According to one aspect of the present invention, an image forming apparatus includes a plurality of photoconductors on which developer images having carrier rates different from each other are formed by corresponding liquid developers. An image transfer member is disposed to form transfer nips with the respective photoconductors in such a manner that the developer images of the respective photoconductors are overlappingly transferred onto the image transfer member according to a transfer order predetermined on the basis of the carrier rates thereof. The developer images are moved from the respective photoconductors to an image receiving medium.

Preferably, the transfer order is determined so that the higher the carrier rate, the earlier the developer image is transferred.

Preferably, each of the carrier rates is a rate of carrier for a solid in a toner contained in the liquid developer of each of the developer images. The carrier rate for the solid in the toner may be regulated by changing one of the rate and the composition of an organosol contained in the toner.

In an exemplary embodiment of the present invention, the plurality of photoconductors includes four photoconductors on which developer images having carrier rates different from each other are formed. Each of the carrier rates is a rate of carrier for a solid in a toner contained in the liquid developer of each of the developer images. The developer images formed on the four photoconductors have carrier rates that are in the range of 100% through 130%, 80% through 110%, 60% through 90%, and 30% through 70%, respectively.

According to another aspect of the present invention, an image forming method includes the steps of forming developer images having carrier rates different from each other on a plurality of photoconductors with corresponding liquid developers. The developer images formed on the plurality of photoconductors are successively transferred onto an image transfer member according to a transfer order predetermined on the basis of the carrier rates of the developer images.

Preferably, the transfer order is determined so that the higher the carrier rate, the earlier the developer image is transferred.

Preferably, each of the carrier rates is a rate of carrier for a solid in a toner contained in the liquid developer of each of the developer images. The carrier rate for the solid in the toner may be regulated by changing one of the rate and the composition of an organosol contained in the toner.

In an exemplary embodiment of the present invention, the step of forming the developer images may include forming four developer images having carrier rates different from each other on four photoconductors. Each of the carrier rates is a rate of carrier for a solid in a toner contained in the liquid developer of each of the developer images. The step of successively transferring the developer images may include transferring the four developer images formed on the four photoconductors onto the image transfer member in an order that the higher the carrier rate is, the earlier the developer image is transferred. Preferably, the four developer images formed on the four photoconductors have carrier rates that are in the range of 100% through 130%, 80% through 110%, 60% through 90%, and 30% through 70%, respectively.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above aspects and features of the present invention will be more apparent from the description for certain embodiments of the present invention taken with reference to the accompanying drawings, in which.

Throughout the drawings, like reference numerals will be understood to refer to like parts, components and structures.

DETAILED DESCRIPTION OF EXEMPLARY EMBODIMENTS

Hereinbelow, exemplary embodiments of the present invention are described in more detail with reference to the accompanying drawings.

The matters defined in the description such as a detailed arrangement and elements are provided to assist in a comprehensive understanding of the invention. Thus, it is apparent that the present invention may be carried out without those defined matters. Also, descriptions of conventional functions and arrangements are omitted to provide a clear and concise description of the exemplary embodiments.

Figure 3:
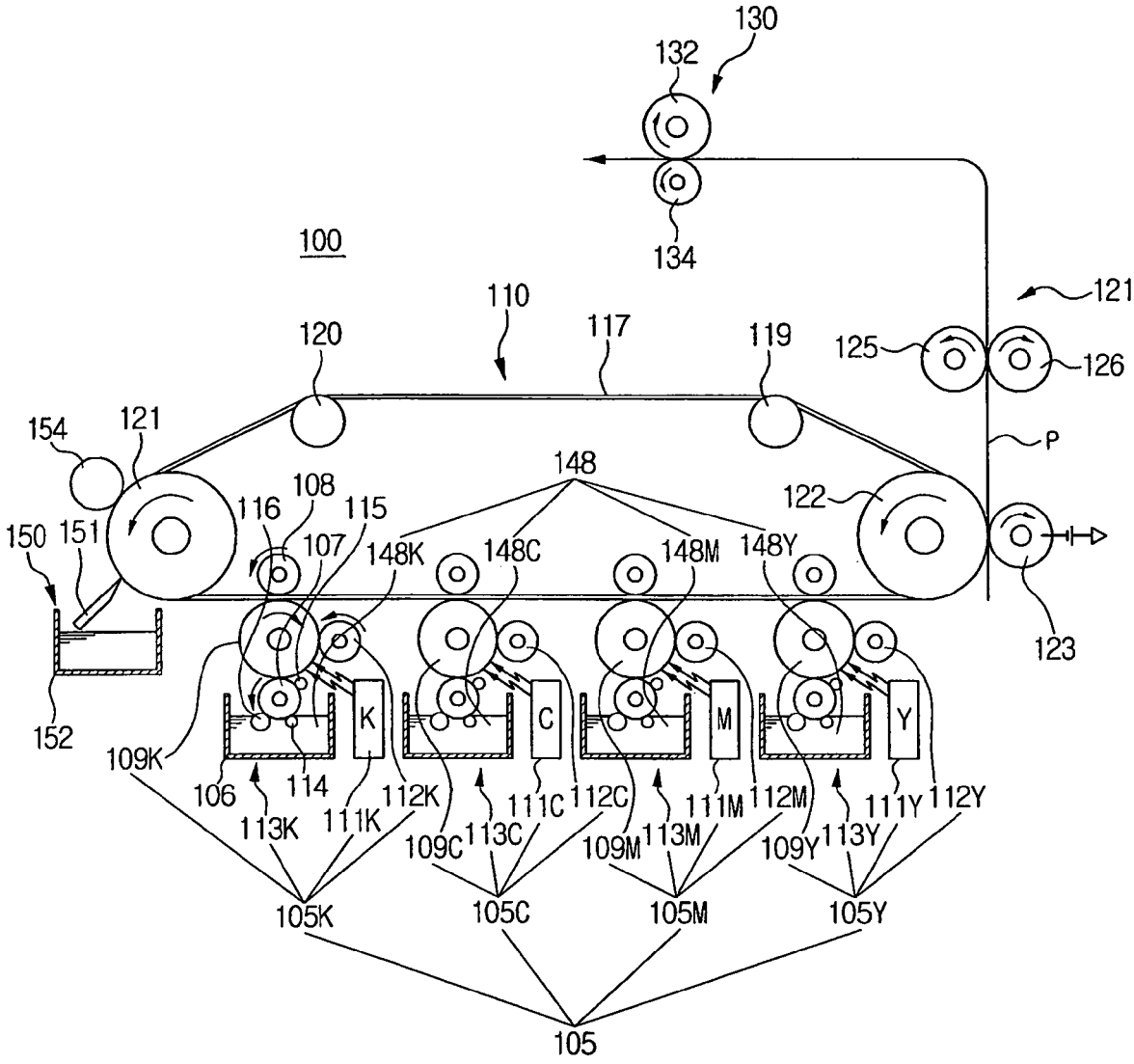
FIG. 3 is a schematic view of a wet type electrophotographic printer according to an exemplary embodiment of the present invention.

FIG. 3 schematically shows an image forming apparatus according to an exemplary embodiment of the present invention.

The image forming apparatus according to an exemplary embodiment of the present invention is a wet type electrophotographic color printer 100 that implements printing by internally processing print data transmitted from a computer (not shown) or the like.

As shown in FIG. 3, the wet type electrophotographic color printer 100 includes an image forming unit 105, an image transfer unit 110, an image fixing unit 121, a paper discharge unit 130, and a cleaning unit 150.

The image forming unit 105 includes four image forming units, for example K, C, M, and Y image forming units 105K, 105C, 105M, and 105Y to form developer images 149 (see FIG. 4) (149K, 149C 149M and 149Y of FIG. 8) of four colors, that is, black (K), cyan (C), magenta (M) and yellow (Y).

Each of the K, C, M, and Y image forming units 105K, 105C, 105M, and 105Y is provided with K, C, M, and Y photoconductors 109K, 109C, 109M, and 109Y; K, C, M, and Y electrification rollers 112K, 112C, 112M, and 112Y; K, C, M, and Y laser scanning units 11K, 111C, 111M, and 111Y; and K, C, M, and Y developing devices 113K, 113C, 113M, and 113Y.

The K, C, M, and Y photoconductors 109K, 109C, 109M, and 109Y, each of which is formed of an organic photoconductive drum, are disposed to form transfer nips with an image transfer belt 117 therebetween. On the K, C, M, and Y photoconductors 109K, 109C, 109M, and 109Y, the K, C, M, and Y developer images 149K, 149C 149M and 149Y having a density in the range of, for example, 20 through 25% solid are respectively formed by developing rollers 107 of the K, C, M, and Y developing devices 113K, 113C, 113M, and 113Y, which are described below. The K, C, M, and Y developer images 149K, 149C 149M and 149Y are formed respectively to have different carrier rates, each of which is a rate of carrier for a solid 170 (see FIG. 6) in a toner 163 (see FIG. 5) and is predetermined according to an exemplary embodiment of the present invention as described below.

The K, C, M, and Y electrification rollers 112K, 112C, 112M, and 112Y are respectively disposed to contact surfaces of the K, C, M, and Y photoconductors 109K, 109C, 109M, and 109Y, for electrifying surfaces thereof with a predetermined electric potential.

The K, C, M, and Y laser scanning units 111K, 111C, 111M, and 111Y are respectively located below the K, C, M, and Y electrification rollers 112K, 112C, 112M, and 112Y, for emitting light beams onto the electrified surfaces of the K, C, M, and Y photoconductors 109K, 109C, 109M, and 109Y to form electrostatic latent images thereon.

The K, C, M, and Y developing devices 113K, 113C, 113M, and 113Y are respectively installed below the respective K, C, M, and Y photoconductors 109K, 109C, 109M, and 109Y, for developing the electrostatic latent images into corresponding K, C, M, and Y developer images 149K, 149C 149M and 149Y with K, C, M, and Y liquid developers 148K, 148C, 148M and 148Y.

Figure 4:
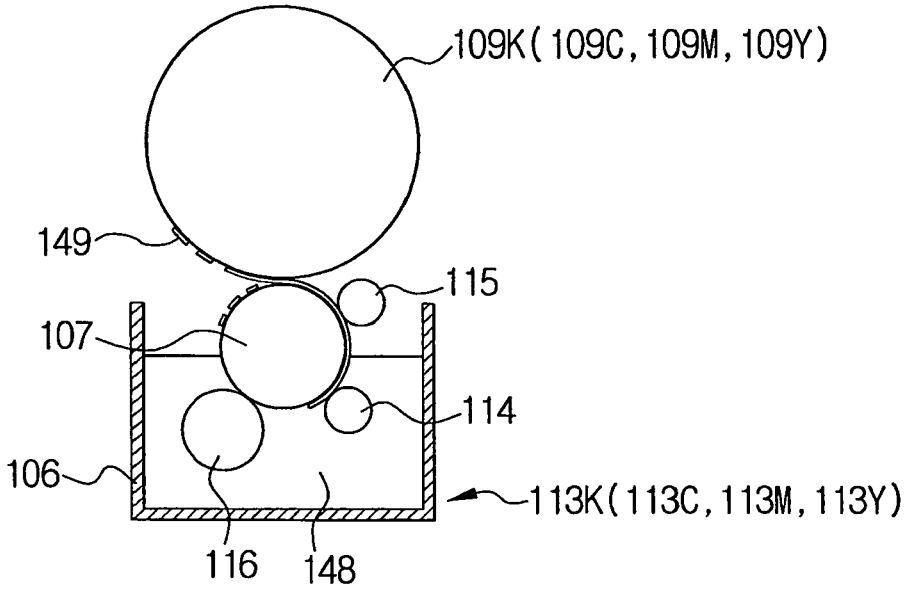
FIG. 4 is a schematic view exemplifying an image forming operation of the wet type electrophotographic printer of FIG. 3.

As shown in FIG. 4, each of the K, C, M, and Y developing devices 113K, 113C, 113M, and 113Y include a storage part 106, a developing roller 107, a deposit roller 114, a metering roller 115, and a cleaning roller 116.

The storage part 106 reserves corresponding liquid developer 148, that is, the K, C, M, or Y liquid developer 148K, 148C 148M or 148Y. The K, C, M, or Y liquid developer 148K, 148C 148M or 148Y has a high density in the range of, for example, 3 through 20% solid, and a rate of carrier for a solid 170 in a toner 163 predetermined according to an exemplary embodiment of the present invention, as described below. The developing roller 107 is located below the corresponding photoconductor 109K, 109C, 109M, or 109Y. The deposit roller 114 is located below the developing roller 107 and applies electric force to the corresponding liquid developer 148, thereby forming a layer of electrified developer on the developing roller 107. The metering roller 115 applies a predetermined level of voltage to the electrified developer layer formed on the developing roller 107 by the deposit roller 114 and at the same time regulates the electrified developer layer to a developer layer having a predetermined amount of toner or density (for example 12 through 20% solid), and supplies the regulated developer layer to a nip between the developing roller 107 and the corresponding photoconductor 109K, 109C, 109M, or 109Y. The cleaning roller 116 cleans the developing roller 107.

The deposit roller 114 and the metering roller 115 supply the layer of developer having the density in the range of 12 through 20% solid to the nip between the developer roller 107 and the corresponding photoconductor 109K, 109C, 109M, or 109Y regardless of a change in the density of the liquid developer 148, which preferably has the high density in the range of 3 through 20% solid, or if the density of the liquid developer 148 fluctuates while being used.

To prevent producing an image defect, such as flow pattern, image dragging and the like, when the K, C, M, and Y developer images 149K, 149C 149M and 149Y formed on the photoconductor 109K, 109C, 109M, and 109Y are transferred onto the image transfer belt 117, the K, C, M, and Y image forming units 105K, 105C, 105M, and 105Y of the present invention are configured in such a manner that the carrier rates, especially the rates of carrier for the solid 170 in the toner 163 of the K, C, M, and Y liquid developers 148K, 148C 148M and 148 contained in the K, C, M, and Y developer images 149K, 149C 149M and 149Y are different according to a transfer order of the developer images 149K, 149C 149M and 149Y to transfer onto the image transfer belt 117.

Figure 1:
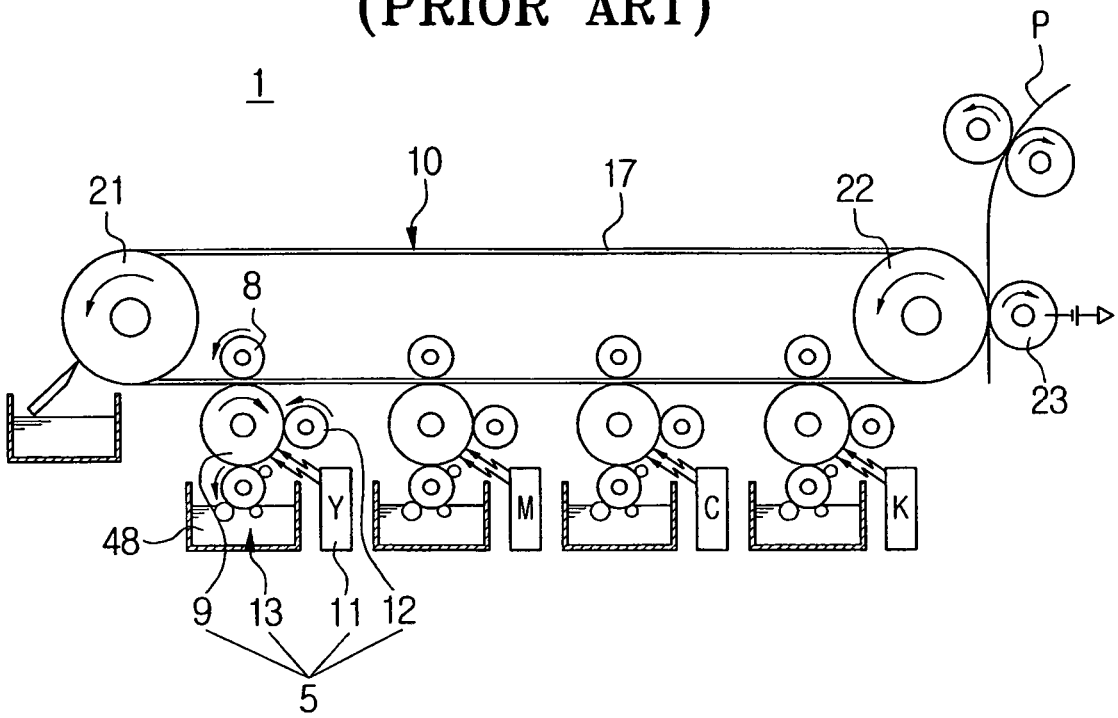
FIG. 1 (PRIOR ART)
FIG. 1 is a schematic view of a conventional wet type electrophotographic printer.
Figure 2:
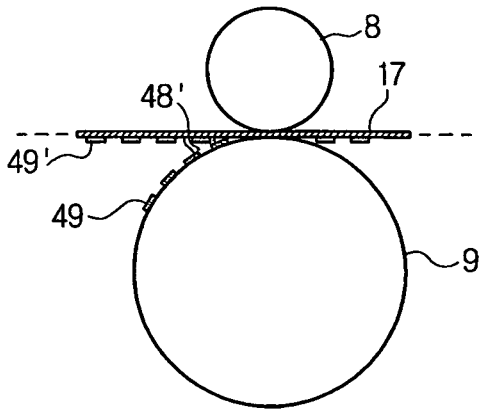
FIG. 2 (PRIOR ART)
FIG. 2 is a schematic view exemplifying a transfer operation of a photoconductor of the wet type electrophotographic printer of FIG. 1.

More specifically, as explained in the description of the related art with reference to FIGS. 1 and 2, in the conventional printer 1 when the developer images are overlappingly transferred from the respective photoconductors 9 to the image transfer belt 17, the squeeze carrier 48' is squeezed and generated from not only the developer image 49 that is newly transferred onto the image transfer belt 17 but also the developer image 49' that is previously transferred thereonto, and accumulated at the inlet sides of transfer nips between the respective photoconductors 9 and the image transfer roller 17. Thus, the image defects, such as flow pattern, image dragging and the like, that result from an increase in the amount of the squeezed carrier 48' beyond the predetermined limit may be produced as the developer images are transferred onto the image transfer belt 17.

To solve this problem, the K, C, M, and Y image forming units 105K, 105C, 105M, and 105Y of an exmplary embodiment of the present invention are configured in such a manner that the rates of carrier for the solid 170 in the toner 163 of the K, C, M, and Y liquid developers 148K, 148C 148M and 148 contained in the K, C, M, and Y developer images 149K, 149C 149M and 149Y formed on the photoconductor 109K, 109C, 109M, and 109Y are gradually reduced in a transfer order of the developer images 149K, 149C, 149M and 149Y to be transferred onto the image transfer belt 117, that is, an order of K, C, M and Y. Accordingly, when the K, C, M, and Y developer images 149K, 149C 149M and 149Y of the K, C, M, and Y photoconductor 109K, 109C, 109M, and 109Y are transferred onto the image transfer belt 117 at the respective transfer nips, a squeezed carrier is not generated at the posterior transfer nip beyond a predetermined limit from the developer image 149K, 149C or 149M that has already been transferred onto the image transfer belt 117 at the prior transfer nip and the developer image 149C, 149M or 149Y that is newly transferred thereonto. Thus, the squeezed carrier in liquid state is not accumulated at inlet sides of the respective transfer nips to a limit that results in image defects, thereby preventing the image defects from being produced due to the squeezed carrier.

In an exmplary embodiment of the present invention, the K, C, M, and Y photoconductor 109K, 109C, 109M, and 109Y of the K, C, M, and Y image forming units 105K, 105C, 105M, and 105Y thereon form K, C, M, and Y developer images 149K, 149C 149M and 149Y having rates of carrier for the solid 170 in the toner 163 that are preferably in the range of 100% through 130%, 80% through 110%, 60% through 90%, and 30% through 70%, respectively. For this, the storage parts 106 of the K, C, M, and Y developing devices 113K, 113C, 113M, and 113Y store K, C, M, and Y liquid developer 148K, 148C 148M and 148Y having corresponding carrier rates, that is, rates of carrier for the solid 170 in the toner 163 that are in the range of 100% through 130%, 80% through 110%, 60% through 90%, and 30% through 70%, respectively.

Preventing the squeezed carrier in liquid state from being accumulated at the inlet sides of the respective transfer nips results in the elimination of image defects. The K, C, M, and Y image forming units 105K, 105C, 105M, and 105Y are configured in such a manner that the rates of carrier for the solid 170 in the toner 163 of the K, C, M, and Y liquid developers 148K, 148C 148M and 148Y contained in the K, C, M, and Y developer images 149K, 149C 149M and 149Y formed on the photoconductors 109K, 109C, 109M, and 109Y are gradually reduced, which is further explained below.

Figure 5:
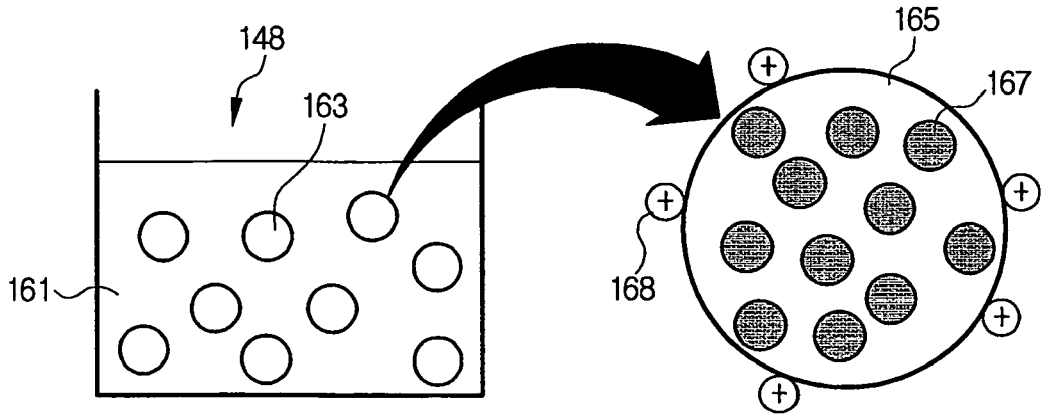
FIG. 5 is a conceptual diagram exemplifying the formation of a general liquid developer.

As shown in FIG. 5, liquid developers 148 of K, C, M, and Y are generally a mixture in which powdered toner 163 is mixed with liquid carrier 161 (referred to as "outer norpar" below). The outer norpar 161 includes a liquid of volatile components, such as norpar No. 12. The toner 163 includes a pigment 167 for representing colors, an electrification control agent 168, and an organosol 165 of high molecular substance containing a liquid carrier 169 (referred to as "intra-norpar" below; see FIG. 6), such as norpar No. 12. Components of the pigment 167 and the electrification control agent 168, except for the intra-norpar 169 of the organosol 165, are solids 170 (see FIG. 6).

Thus, the liquid developers 148 include the liquid carrier having the outer norpar 161 distributed outside of the toner 163 and the intra-norpar 169 contained in the toner 163. Accordingly, carrier rates of the liquid developers 148 may be regulated by changing the amount of any one of the outer norpar 161 or the intra-norpar 169.

However, the liquid carrier, that is, the outer norpar 161 and the intra-norpar 169, contained in the respective developer images 149K, 149C 149M and 149Y formed on the photoconductors 109K, 109C, 109M, and 109Y show characteristics as described below when the respective developer images 149K, 149C 149M and 149Y are transferred while squeezing at the transfer nips between the respective photoconductors 109K, 109C, 109M, and 109Y and the image transfer belt 117.

Figure 6:
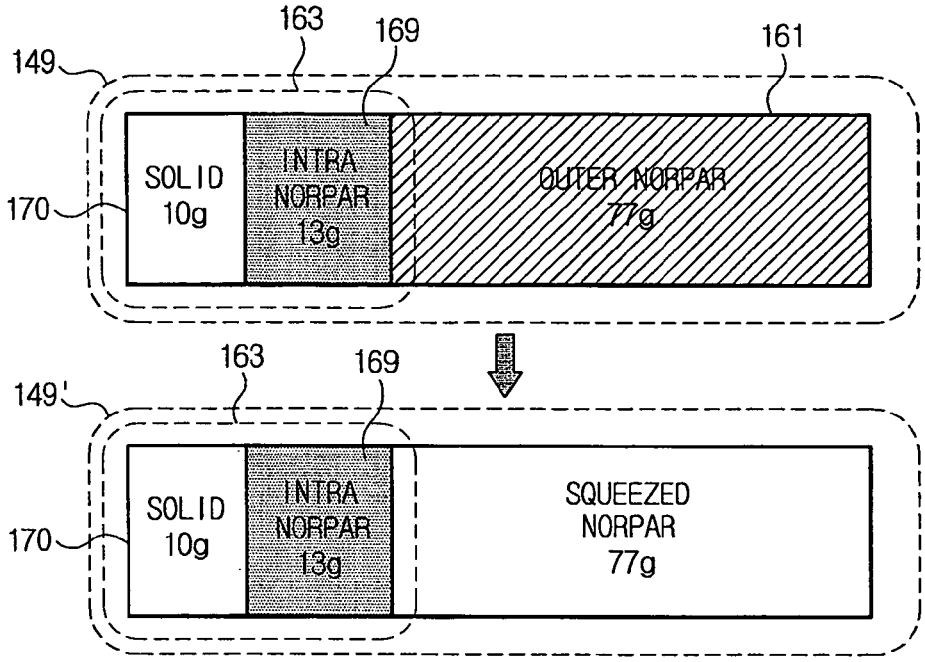
FIG. 6 is a conceptual diagram exemplifying the change in amount of an intra-norpar and an outer norpar when a developer image formed on a photoconductor is physically squeezed.

FIG. 6 exemplifies the change in the amount of intra-nopar 169 and the outer norpar 161 in developer images 149 of about 100 g having a density of about 10% solid when the developer image 149 is physically squeezed. In the developer image 149 of about 100 g, intra-norpar 169 of about 13 g, such as norpar No. 12, contained in organosol 165 of toner 163 of about 23 g including solid 170 of about 10 g composed of pigment 167 and the like except for intra-norpar 169 of the organosol 165, and outer norpar 161 of about 77 g, such as norpar No. 12, were contained.

As shown in FIG. 6, after being squeezed, the developer image 149 of about 100 g having a density of about 10% solid was changed into a developer image 149' of about 23 g having a density of about 43% solid (10 g of solid of 23 g developer image 149' because 77 g of outer norpar 161 being removed by squeezing). Also, the outer norpar 161 was squeezed and removed, and not the intra-norpar 169, thereby representing no change in the amount thereof. Thus, it may be appreciated that since the outer norpar 161 is apt to be physically squeezed, but the intra-norpar 169 is not easily squeezed and removed when the developer image 149 is squeezed, the density of the developer image 149' squeezed is greatly affected by the intra-norpar 169.

Figure 7:
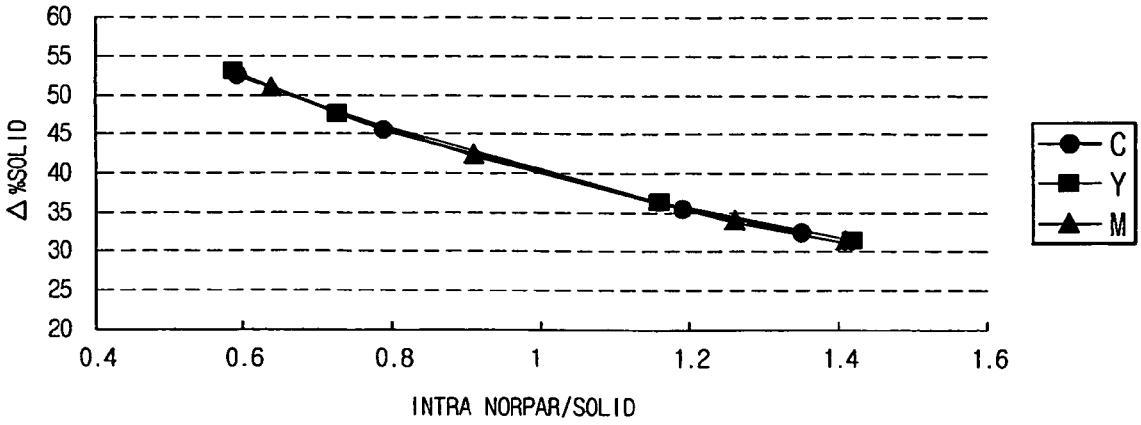
FIG. 7 is a graph exemplifying the relation between a squeezing efficiency and a rate of intra-norpar for a solid at a general developer image having a density of 10% solid.

FIG. 7 shows relation between a squeezing efficiency (Δ% Solid) and a rate (Intra Norpar/Solid) of intra-norpar 169 for a solid 170 at general K, C, M and Y developer images 149 having a density of 10% solid.

As apparent from in FIG. 7, it may be appreciated that the squeezing efficiency is varied according to amount of the intra-norpar 169. That is, for developer images 149 of substantially similar density, if the amount of the intra-norpar 169 is small, the squeezing efficiency is ameliorated, and if the amount of the intra-norpar 169 is large, the squeezing efficiency is deteriorated.

Thus, since the intra-norpar 169 of the developer images 149 is not removed well when squeezed, if increasing the amount of the intra-norpar 169 it is possible to reduce the squeezing efficiency, that is, the amount of the squeezed carrier accumulated at the inlets of the transfer nips between the respective photoconductors 109K, 109C, 109M and 109Y and the image transfer belt 117 when the developer images 149 are transferred onto the image transfer belt 117.

Accordingly, by using the principle as described above, the present invention configures K, C, M, and Y image forming units 105K, 105C, 105M, and 105Y in such a manner that the amount of the intra-norpar 169 in the toner 163 contained in the developer images 149, that is, the rate of carrier for the solid 170 in the toner 163, is larger at the developer images 149K, 149C and/or 149M of the photoconductors 109K, 109C and/or 109M to previously transfer than at the developer images 149C, 149M and/or 149Y of the photoconductors 109C, 109M and/or 109Y to later transfer, thereby reducing the amount of the squeezed carrier accumulated at the inlets of the transfer nips between the photoconductors 109C, 109M and/or 109Y to later transfer and the image transfer belt 117. Thus, image defects are substantially prevented from being produced due to the squeezed carrier.

According to experiments executed by the inventors, it has been verified that when rates of carrier for the solid 170 in the toner 163 contained in the K, C, M, and Y developer images 149K, 149C 149M and 149Y are in the range of 100% through 130%, 80% through 110%, 60% through 90%, and 30% through 70%, respectively, the K, C, M, and Y developer images 149K, 149C 149M and 149Y may be transferred very well onto the image transfer belt 117 without producing image defects, such as flow pattern, image dragging and the like, due to the squeezed carrier.

Figure 8:
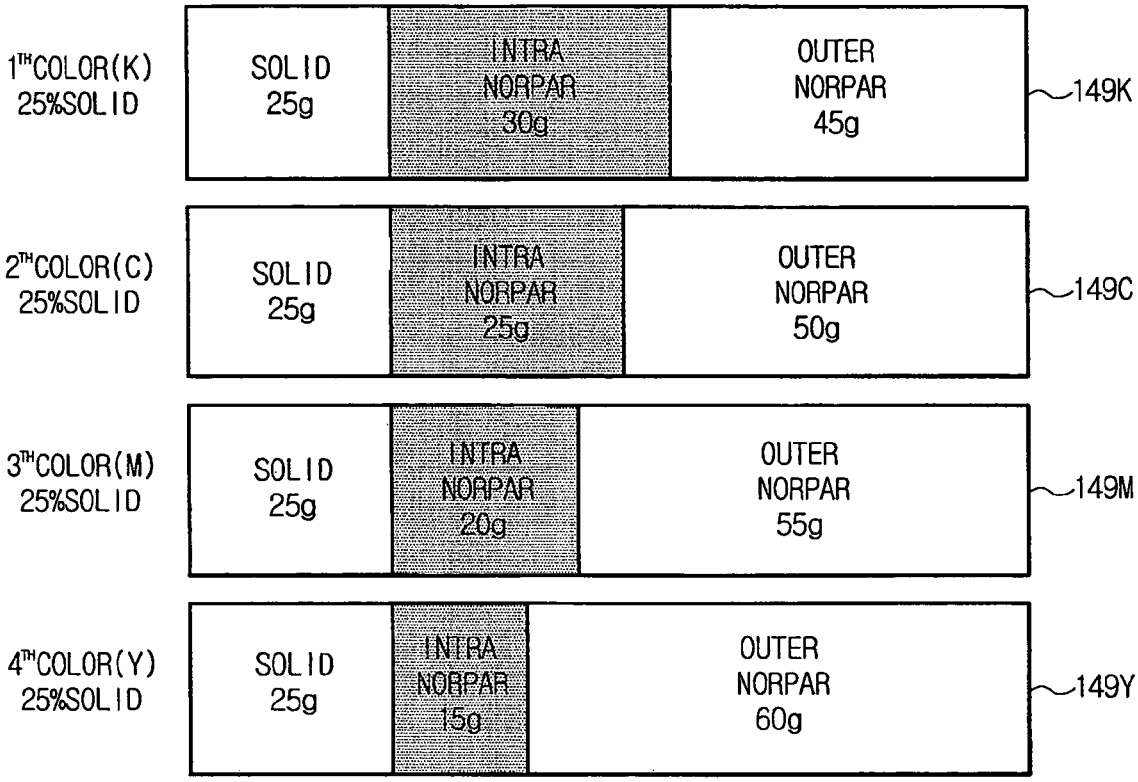
FIG. 8 is a conceptual diagram exemplifying a rate of carrier for a solid in a toner of each of the developer images formed on photoconductors of the wet type electrophotographic printer shown in FIG. 3.

More specifically, as shown in FIG. 8, when the K, C, M, and Y developer images 149K, 149C 149M and 149Y of 100 g have included solids 170 having weights of about 25 g for the same density of about 25% solid, and intra-norpars 169 in the range of 25 through 32.5 g, 20 through 27.5 g, 15 through 22.5 g, and 7.5 through 17.5 g, preferably about 30 g, about 25 g, about 20 g, and about 15 g, respectively, thereby to have rates of carrier for the solid 170 in the toner 163 in the range of approximately 100% through 130%, approximately 80% through 110%, approximately 60% through 90%, and approximately 30% through 70%, preferably, about 120%, about 100%, about 80% and about 60%, respectively, they may be transferred very well onto the image transfer belt 117 without producing image defects in the images, such as flow pattern, image dragging and the like, due to the squeezed carrier.

These rates of carrier for the solid 170 in the toner 163 may be regulated by changing rate or composition of the organosol 165 contained in the toner 163 in fabrication of the liquid developers 148.

Figure 9:
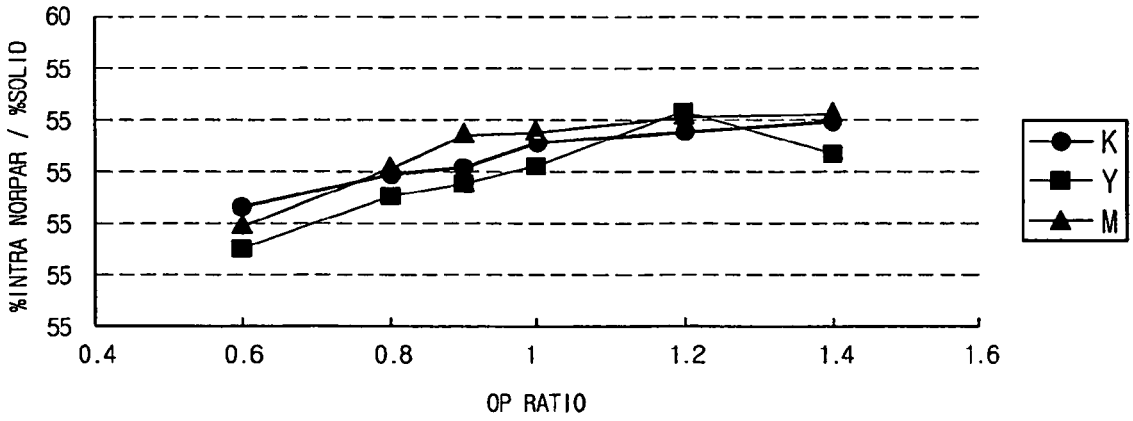
FIG. 9 is a graph exemplifying the relation between a rate of intra-norpar for density and a rate of organosol and pigment in a liquid developer.

More specifically, according to content analysis of general liquid developers 148 of K, C, M and Y, if the amount of organosol 165 is increased then the amount of intra-norpar 169 is also increased in proportion thereto, as evidence by the graph of FIG. 9 exemplifying the relation between a rate (% Intra Norpar/% solid) of intra-norpar 169 for density (% solid) and a rate (OP RATIO) of organosol 165 and pigment 167 in liquid developers 148. That is, the amount of the intra-norpar 169 may be regulated by changing the rate or composition of the organosol 165 in the liquid developers 148.

Referring again to FIG. 3, the image transfer unit 110 has four first image transfer rollers 108, a second image transfer roller 123 and an image transfer belt 117, which move the developer images 149K, 149C 149M and 149Y formed on the respective photoconductors 109K, 109C, 109M, and 109 to an image receiving medium P, such as a sheet of record paper. The image transfer belt 117 rotates along a path of an endless track on first, second and third support rollers 119, 120, 121 driven by a belt driving roller 122. Each first image transfer roller 108 applies a predetermined voltage and pressure to the K, C, M or Y developer image 149K, 149C, 149M or 149Y formed on the corresponding photoconductor 109K, 109C, 109M or 109Y to form a developer image having density in the range of, for example, 25 through 30% solid, and at the same time overlappingly transfers the developer image onto the image transfer belt 117. The second image transfer roller 123 transfers the developer image transferred to the image transfer belt 117 to the image receiving medium P.

The image fixing unit 121 includes heating roller 125 and compressing roller 126 that fix the developer image transferred to the image receiving medium P. The heating roller 125 applies heat to the developer image transferred to the image receiving medium P, and the compressing roller 126 compresses the image receiving medium P against the heating roller 125 with a predetermined pressure.

The paper-discharging unit 130 includes a paper-discharge roller 132 and a paper-discharge backup roller 134, which discharge the image receiving medium P with the developer image fixed by heat and pressure applied by the heating roller 125 and the compressing rollers 126 out of the printer.

The cleaning unit 150 includes a cleaning roller 154, a cleaning blade 151, and a waste developer storage part 152, which clean developer refuse remaining on the image transfer belt 117 after the developer image is transferred onto the image receiving medium P. The cleaning roller 154 firstly cleans the developer refuse remaining on the image transfer roller 117, and the cleaning blade 151 removes the developer refuse firstly cleaned by the cleaning roller 154. The waste developer storage part 152 reserves the developer refuse removed from the image transfer belt 117 by the cleaning blade 151.

Although it has been exemplified herein that in the wet type electrophotographic color printer 100 of the present invention, the K, C, M, and Y image forming units 105K, 105C, 105M, and 105Y are configured to have the transfer order of K, C, M and Y, this should not be considered as limiting. That is, the K, C, M, and Y image forming units 105K, 105C, 105M, and 105Y may be configured to have any other transfer order. For example, the image forming units may be ordered Y, M, C, and K, as in the conventional printer 1 explained with reference to FIG. 1, if it meets the condition that the larger the rate of carrier for the solid 170 in the toner 163 of the liquid developer 148 contained in the developer image 149 formed on each photoconductor 109K, 109C, 109M or 109Y, the earlier the developer image 149 is transferred.

Also, although it has been exemplified herein that the image forming apparatus according to the present invention is applied to the wet type electrophotographic color printer 100 having the image transfer belt 117 as an image transfer member, it may be applied to other image forming apparatus, for example, a wet type electrophotographic color printer having an image transfer drum as an image transfer member in substantially the same principle and construction.

Figure 10:
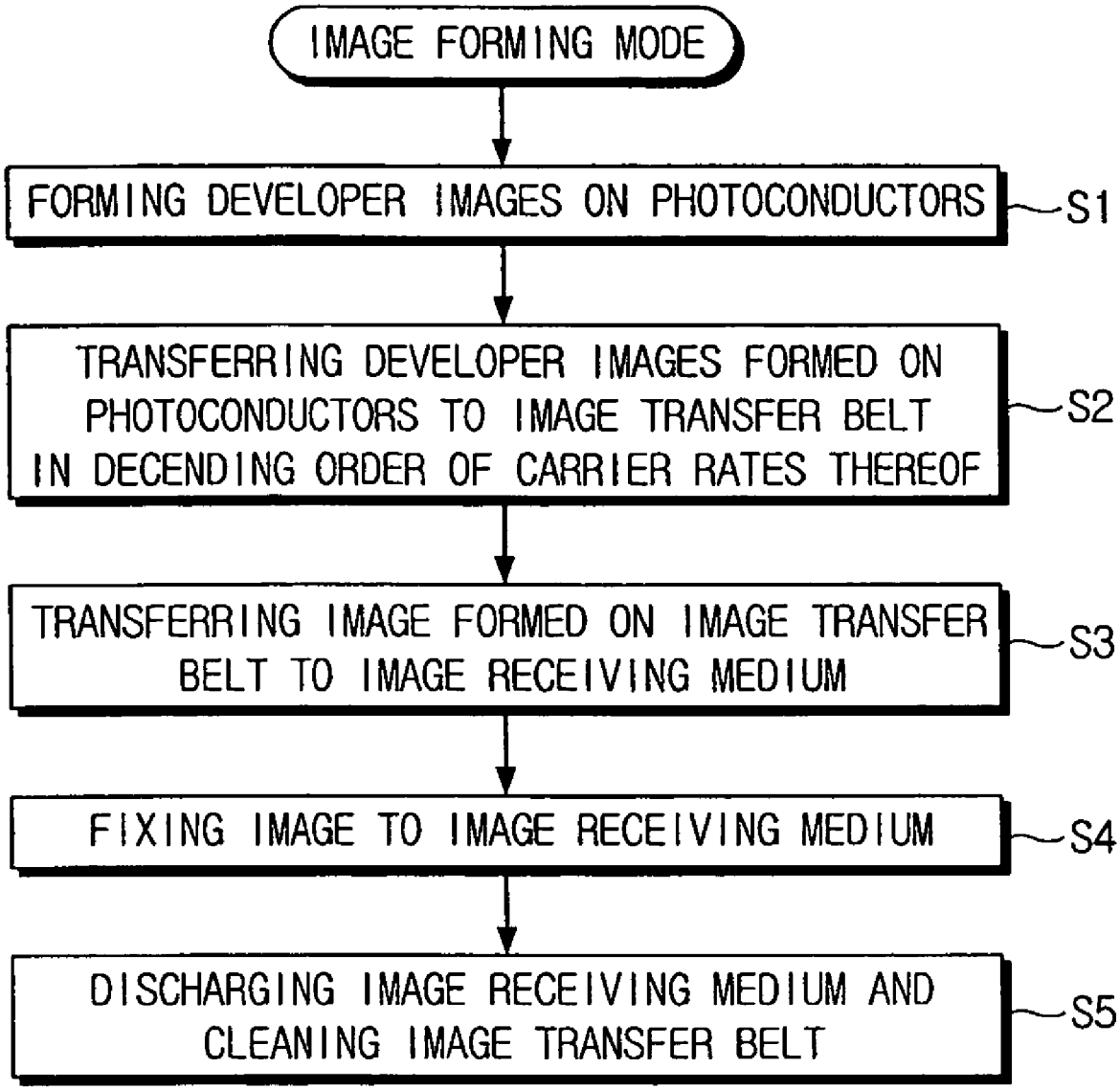
FIG. 10 is a flowchart exemplifying a process of an image forming method of the wet type electrophotographic printer of FIG. 3.

Hereinafter, an image forming method of the wet type electrophotographic printer 100 according to an exemplary embodiment of the present invention configured as described above is explained with reference to FIG. 10.

At first, as a print command is applied, the K, C, M and Y image forming units 105K, 105C, 105M and 105Y operate respective components thereof to perform a series of image forming operations for forming four colors of K. C, M and Y (Step S1).

Specifically, each of the K, C, M and Y photoconductors 109K, 109C, 109M and 109Y is formed with an electrified layer, that is, an electrostatic latent image corresponding to a color image to be printed by corresponding K, C, M or Y electrification roller 112K, 112C, 112M or 112Y and corresponding K, C, M or Y scanning roller 111K, 111C, 111M or 111Y. The formed electrostatic latent image part is deposited with toner of a developer layer having a predetermined amount of toner or density in the range of, for example, 12 through 20% solid, which is formed on corresponding developing roller 107 from the K, C, M or Y liquid developer 148K, 148C, 148M or 148Y having a density in the range of, for example, 3 through 15% solid stored in a corresponding storage part 106, whereby the K, C, M or Y developer image 149K, 149C, 149M or 149Y having a density in the range of, for example, 20 through 25% solid, is formed.

At this time, though the densities of the K, C, M and Y liquid developer 148K, 148C, 148M and 148Y are changed as the K, C, M and Y liquid developer 148K, 148C, 148M and 148Y are moved from the storage parts 106 of the respective developing devices 113K, 113C, 113M and 113Y to the K, C, M and Y photoconductors 109K. 109C, 109M, rates of carrier for the solid 170 in the toner 163 thereof are not changed, but maintained in the range of 100% through 130%, 80% through 110%, 60% through 90%, and 30% through 70%, respectively.

The K, C, M and Y developer image 149K, 149C, 149M and 149Y formed on the K, C, M and Y photoconductors 109K. 109C, 109M and 109Y by the respective developing devices 113K, 113C, 113M and 113Y are overlappingly transferred onto the image transfer belt 117 at the transfer nips between the K, C, M and Y photoconductors 109K, 109C, 109M and 109Y and the image transfer belt 117 by voltage and pressure of the first transfer roller 108 located inside of the image transfer belt 117, thereby forming a developer image having a density in the range of, for example, 25 through 30% solid (Step S2).

At this time, the K developer image 149K formed on the K photoconductor 109K to firstly carry out a transfer operation further passes through transfer nips between the C, M and Y photoconductor 109C, 109M and 109Y to next carry out transfer operation and the image transfer belt 117 until all the developer images 149K, 149C, 149M and 149Y formed on the K, C M and Y photoconductors 109K, 109C, 109M and 109Y are completely transferred onto the image transfer belt 117. The C developer image 149C formed on the C photoconductor 109C to secondly carry out transfer operation further passes through the transfer nips between the M and Y photoconductor 109M and 109Y to next carry out transfer operation and the image transfer belt 117. The M developer image 149M formed on the M photoconductor 109M to thirdly carry out transfer operation further passes through the transfer nip between the Y photoconductor 109Y to next carry out transfer operation and the image transfer belt 117.

Thus, each of the K, C, M and Y developer images 149K, 149C, 149M or 149Y is squeezed passing through more transfer nips in the order of K, C, M and Y, but each of the K, C, M and Y liquid developers 148K, 148C, 148M or 148Y of the K, C, M and Y developer images 149K, 149C, 149M and 149Y has a rate of carrier for the solid 170 in the toner 163 contained therein higher in the order of K, C, M and Y. Therefore, the amount of squeezed carrier, which is squeezed from the K, C, and/or M developer images 149K, 149C and/or 149M previously transferred onto the image transfer belt 117 from the K, C and/or M photoconductor 109K, 109C and/or 109M while the C, M and/or Y developer images 149C, 149M and/or 149Y of the C, M and/or Y photoconductor 109C, 109M and/or 109Y are overlapped and transferred onto the K, C, and/or M developer images 149K, 149C and/or 149M, is greatly reduced. As a result, the amount of the squeezed carrier accumulated at the inlets of the transfer nips between the C, M and/or Y photoconductors 109C, 109M and/or 109Y and the image transfer belt 117 is considerably reduced and maintained within a predetermined limit. Thus, the image defects, such as flow pattern, image dragging and the like, are substantially prevented from being produced due to the squeezed carrier.

As the image transfer belt 117 is rotated along the first, second and third support rollers 119, 120, 121 by the belt driving roller 122, the developer image formed by being transferred to the image transfer belt 117 is moved to the second image transfer roller 123, and transferred to the image receiving medium P by voltage and pressure exerted by the second image transfer roller 123 (Step S3).

The image transferred to the image receiving medium P is fixed on the image receiving medium P by the heating roller 125 and the compressing roller 126, thus finally forming a desired image (Step S4).

Thereafter, the image receiving medium P is discharged out of the printer by the paper-discharge roller 132 and the paper-discharge backup rollers 134 of the paper discharge unit 130. After the developer image formed on the image transfer belt 117 has been transferred to the image receiving medium P, the image transfer belt 117 is continuously rotated and arrives at the cleaning roller 154 mounted in such a manner that the cleaning roller 154 comes into contact with the image forming surface of the image transfer belt 117 at a side of the third support roller 121. Developer refuse remaining on the surface of the image transfer belt 117 (typically 90-98% of developer is transferred to a sheet of record paper rather than 100%) is primarily cleaned by the cleaning roller 154, removed from the image transfer belt 117 by the cleaning blade 151, and then recovered to the waste developer storage part 152 so as to print a next image (Step S5).

After the remaining developer refuse has been removed from the image transfer belt 117, the image transfer belt 117 performs again the above-mentioned operations through the respective photoconductors 109K, 109C, 109M and 109Y, the respective laser scanning units 111K, 111C, 111M and 111Y and the respective developing devices 113K, 113C, 113M and 113Y.

As described above, in the image forming apparatus and the method thereof according to exemplary embodiments of the present invention, the developer images formed on the plurality of photoconductors are overlappingly transferred onto the image transfer member according to the transfer order predetermined on the basis of the carrier rates thereof. Therefore, when the developer images are transferred from the respective photoconductors to the image transfer member, the developer images previously transferred at the prior transfer nips are substantially prevented from generating the squeezed carrier beyond the predetermined limit at the posterior transfer nips, so that the squeezed carrier is substantially prevented from accumulating beyond the predetermined limit at the inlet side of the posterior transfer nips. Accordingly, image defects, such as flow pattern, image dragging and the like, that result from an increase in the amount of the squeezed carrier beyond the predetermined limit is substantially prevented from being produced.

While the preferred embodiment of the present invention has been shown and described in order to exemplify the principle of the present invention, the present invention is not limited to the specific embodiment. It will be understood that various modifications and changes may be made by one skilled in the art without departing from the spirit and scope of the invention as defined by the appended claims. Therefore, it shall be considered that such modifications, changes and equivalents thereof are all included within the scope of the present invention.

What is claimed is:

1. An image forming apparatus, comprising:

a plurality of photoconductors on which developer images having carrier rates different from each other are formed with corresponding liquid developers, each of the carrier rates being the rate of carrier for a solid in a toner contained in the liquid developer of the developer images;

an image transfer member disposed to form transfer nips with each of the plurality of photoconductors in such a manner that the developer images of the plurality of photoconductors are overlappingly transferred onto the image transfer member according to a transfer order predetermined on the basis of the carrier rates thereof; and an image receiving medium to receive the developer images from the image transfer member.

2. The image forming apparatus as claimed in claim 1, wherein the transfer order is determined so that the higher the carrier rate, the earlier the developer image is transferred.

3. The image forming apparatus as claimed in claim 1, wherein the carrier rate for the solid in the toner is regulated by changing one of a rate and a composition of an organosol contained in the toner.

4. The image forming apparatus as claimed in claim 1, wherein the plurality of photoconductors is four photoconductors on which developer images having carrier rates different from each other are formed, each of the carrier rates being a rate of carrier for a solid in a toner contained in the liquid developer of each developer image.

5. The image forming apparatus as claimed in claim 4, wherein the developer images formed on the four photoconductors have carrier rates that are in the range of approximately 100% through 130%, approximately 80% through 110%, approximately 60% through 90%, and approximately 30% through 70%, respectively.

6. The image forming apparatus as claimed in claim 1, wherein the image transfer member is a belt.

7. The image forming apparatus as claimed in claim 1, wherein the image transfer member is a drum.

8. An image forming apparatus, comprising:

four photoconductors on which developer images having carrier rates different from each other are formed with corresponding liquid developers, each of the carrier rates being the rate of carrier for a solid in a toner contained in the liquid developer of the developer images;

an image transfer member disposed to form transfer nips with each of the four photoconductors such that the developer images of the four photoconductors are overlappingly transferred onto the image transfer member according to a transfer order predetermined on the basis of the carrier rates thereof such that each successively transferred developer image has a lower carrier rate; and an image receiving medium to receive the developer images from the image transfer member.

9. The image forming apparatus as claimed in claim 8, wherein the carrier rate for the solid in the toner is regulated by changing one of a rate and a composition of an organosol contained in the toner.

10. The image forming apparatus as claimed in claim 8, wherein the developer images formed on the four photoconductors have carrier rates that are in the range of approximately 100% through 130%, approximately 80% through 110%, approximately 60% through 90%, and approximately 30% through 70%, respectively.

11. The image forming apparatus as claimed in claim 8, wherein the image transfer member is a belt.

12. The image forming apparatus as claimed in claim 8, wherein the image transfer member is a drum.

13. An image forming method for an image forming apparatus, comprising the steps of forming developer images having carrier rates different from each other on a plurality of photoconductors with corresponding liquid developers, each of the carrier rates being the rate of carrier for a solid in a toner contained in the liquid developer of the developer images; and successively transferring the developer images formed on the plurality of photoconductors onto an image transfer member according to a transfer order predetermined on the basis of the carrier rates of the developer images.

14. The image forming method as claimed in claim 13, further comprising arranging the transfer order that the higher the carrier rate, the earlier the developer image is transferred.

15. The image forming method as claimed in claim 13, further comprising changing one of a rate and a composition of an organosol contained in the toner to regulate the carrier rate for the solid in the toner.

16. The image forming method as claimed in claim 13, wherein the step of forming the developer images further comprises forming four developer images having carrier rates different from each other on four photoconductors, each of the carrier rates being a rate of carrier for a solid in a toner contained in the liquid developer of each of the developer images; and wherein the step of successively transferring the developer images further comprises transferring the four developer images formed on the four photoconductors onto the image transfer member in an order that the higher the carrier rate, the earlier the developer image is transferred.

17. The image forming method as claimed in claim 16, further comprising providing the four developer images formed on the four photoconductors with carrier rates in the range of approximately 100% through 130%, approximately 80% through 110%, approximately 60% through 90%, and approximately 30% through 70%, respectively.

* * * * *